US010200793B2

(12) United States Patent
Chang et al.

(10) Patent No.: US 10,200,793 B2
(45) Date of Patent: Feb. 5, 2019

(54) DIAPHRAGM ASSEMBLY AND LOUDSPEAKER HAVING SAME

(71) Applicant: GOERTEK INC., WeiFang (CN)

(72) Inventors: Xiuli Chang, WeiFang (CN); Jianbin Yang, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/549,027

(22) PCT Filed: Dec. 9, 2015

(86) PCT No.: PCT/CN2015/096753

§ 371 (c)(1),
(2) Date: Aug. 4, 2017

(87) PCT Pub. No.: WO2016/150197

PCT Pub. Date: Sep. 29, 2016

(65) Prior Publication Data

US 2018/0041838 A1 Feb. 8, 2018

(30) Foreign Application Priority Data

Mar. 21, 2015 (CN) ..... 2015 2 0168503 U

(51) Int. Cl.

| | |
|---|---|
| ***H04R 7/06*** | (2006.01) |
| ***H04R 7/16*** | (2006.01) |
| ***H04R 1/04*** | (2006.01) |
| ***H04R 31/00*** | (2006.01) |

(52) U.S. Cl.

CPC ..... *H04R 7/06* (2013.01); *H04R 1/04* (2013.01); *H04R 7/16* (2013.01); *H04R 31/003* (2013.01); *H04R 2207/00* (2013.01); *H04R 2231/001* (2013.01); *H04R 2231/003* (2013.01); *H04R 2307/023* (2013.01); *H04R 2307/027* (2013.01)

(58) Field of Classification Search

CPC ... H04R 7/06; H04R 1/04; H04R 7/16; H04R 31/003; H04R 2207/00; H04R 2231/001; H04R 2231/003; B29C 45/14; B32B 15/088; G10K 13/00

USPC ..... 381/423

See application file for complete search history.

(56) References Cited

FOREIGN PATENT DOCUMENTS

| | | | |
|---|---|---|---|
| CN | 103052017 A | | 4/2013 |
| CN | 103209376 A | | 7/2013 |
| CN | 203301720 U | * | 11/2013 |
| CN | 203446018 U | | 2/2014 |
| CN | 203747984 U | | 7/2014 |

(Continued)

OTHER PUBLICATIONS

International Search Report for International Patent Application No. PCT/CN2015/096753 filed on Dec. 9, 2015.

*Primary Examiner* — Sunita Joshi

(57) ABSTRACT

A diaphragm assembly and a loudspeaker having the diaphragm assembly. The diaphragm assembly comprises a silica gel diaphragm, the diaphragm comprises an annular bending portion, and a diaphragm center portion and a diaphragm edge portion arranged on inner and outer sides of the bending portion respectively; an annular support member (40) is joined to the diaphragm edge portion through injection modeling; a dome (30) is joined to the diaphragm center portion; the support member (40) is a metallic member; and the diaphragm edge is at least joined to two surfaces of the support member (40) through injection modeling.

10 Claims, 8 Drawing Sheets

(56) References Cited

FOREIGN PATENT DOCUMENTS

| | | |
|---|---|---|
| CN | 204498359 U | 7/2015 |
| CN | 204598298 U | 8/2015 |

* cited by examiner

DIAPHRAGM ASSEMBLY AND LOUDSPEAKER HAVING SAME

The present application is a U.S. National Stage of PCT/CN2015/096753 filed Dec. 9, 2015, which claims priority to Chinese Patent Application No. 201520168503.X filed on Mar. 21, 2015, the disclosures of which are incorporated herein by reference.

TECHNICAL FIELD

The present application relates to the technical field of electro-acoustic products, and more particularly, to a diaphragm assembly and a loudspeaker having the same.

BACKGROUND ART

A loudspeaker is an important acoustical component in a portable electronic device, is used for transforming electric signal into acoustical signal, and is an energy converter. The loudspeaker typically comprises a vibration system and a magnetic circuit system, the vibration system comprises a diaphragm assembly and a voice coil which are joined together, wherein the diaphragm assembly is an important component of the loudspeaker, which plays a vital role in the sound emission performance of the loudspeaker, and determines the conversion quality of the loudspeaker from electrical energy to sound energy. The existing diaphragm assembly comprises a silica gel diaphragm, and a dome is required to be joined to the middle of the diaphragm in order to adjust acoustic performance. As the silica gel diaphragm is relatively softer, an annular support member is further required to be fixed to the edge portion of the diaphragm. The structure of the existing diaphragm assembly is shown in FIG. 1, the diaphragm 20*a* comprises an annular bending portion, and a diaphragm center portion and a diaphragm edge portion provided at the inner and outer sides of the bending portion, respectively; the upper surface of the support member 40 and the lower surface of the diaphragm edge portion are bonded and fixed to each other via glue, and the dome 30 and the diaphragm center portion are fixed to each other via glue as well. Under the influence of the material of the silica gel diaphragm, such a bonding mode has poor bonding firmness and its stability is not high, and the product has poor consistency. During the operation of the loudspeaker, the silica gel diaphragm is extremely easy to be disengaged from the support member or the dome, which greatly reduces the stability and reliability of the loudspeaker, and greatly shorten the life of the loudspeaker as well.

SUMMARY

In view of the above deficiencies, the first technical problem to be solved by the present application is to provide a diaphragm assembly, wherein the bonding strength between the diaphragm and the support member of the diaphragm assembly is higher, and the product has higher stability and good consistency.

Based on an inventive concept, the second technical problem to be solved by the present application is to provide a loudspeaker which has higher stability and reliability and longer service life.

In order to solve the first technical problem mentioned above, the technical solution of the present application is that:

a diaphragm assembly, comprising a silica gel diaphragm, wherein the diaphragm comprises an annular bending portion, and a diaphragm center portion and a diaphragm edge portion arranged at inner and outer sides of the bending portion, respectively; the diaphragm edge portion is coupled with an annular support member through injection molding, and the diaphragm center portion is coupled with a dome; the support member is a metallic member; and the diaphragm edge portion is coupled with at least two surfaces of the support member through injection molding.

As an implementation, the diaphragm edge portion is simultaneously coupled with an inner lateral surface, an outer lateral surface and an upper surface of the support member through injection molding.

As another implementation, the diaphragm edge portion is simultaneously coupled with an outer lateral surface and an upper surface of the support member through injection molding.

As still another implementation, the diaphragm edge portion is simultaneously coupled with an inner lateral surface and an upper surface of the support member through injection molding.

As still another implementation, the diaphragm edge portion is simultaneously coupled with an inner lateral surface, an outer lateral surface, an upper surface and a lower surface of the support member through injection molding.

Wherein the material of the support member is one of stainless steel or brass.

Wherein the diaphragm center portion is coupled with the dome through adhesive bonding.

Wherein the diaphragm center portion is coupled with the dome through injection molding.

In order to solve the second technical problem mentioned above, the technical solution of the present application is that:

a loudspeaker, comprising a vibration system and a magnetic circuit system, wherein the vibration system comprises the diaphragm assembly mentioned above.

According to the technical solution of the present invention, the advantageous effects of the present application are described below.

As the diaphragm assembly provided by the present application comprises a silica gel diaphragm, the diaphragm edge portion is coupled with an annular support member through injection molding, and the diaphragm center portion is coupled with a dome. The diaphragm and the support member are coupled with each other through injection molding, that is, in the molding of the silica gel diaphragm, the support member is placed in the injection mold as an insert, and then liquid silica gel material is fed to the mold. Thus, the diaphragm is integrated with the support member while molding the diaphragm. Through such a bonding mode, i.e., injection molding, the bonding strength between the diaphragm and the support member is higher, the diaphragm will not be disengaged from the support member during the operation of the loudspeaker, such that the stability and reliability of the product is greatly improved, the consistency of the product is good, its bonding process is simple and easy to operate, thereby improving the production efficiency of the product.

As the diaphragm center portion and the dome are coupled with each other through injection molding as well, the bonding strength between the diaphragm and the dome is improved, the stability and reliability of the product is further improved, the consistency as well as the production efficiency of the product are further improved as well.

As the vibration system of the loudspeaker of the present application comprises the above diaphragm assembly, the diaphragm will not be disengaged from the support member or the dome when the loudspeaker operates, such that the reliability and stability are higher and the service life is longer.

In view of the above, the diaphragm assembly and the loudspeaker having the same provided by the present application have solved the technical problem in the prior art that the silica gel diaphragm is easy to be disengaged from the dome or the support member. In the diaphragm assembly and the loudspeaker having the same provided by the present application, the diaphragm has higher bonding strength with the dome and the support member, the product has higher stability and reliability, higher product consistency, higher production efficiency and longer service life.

Figure 1:
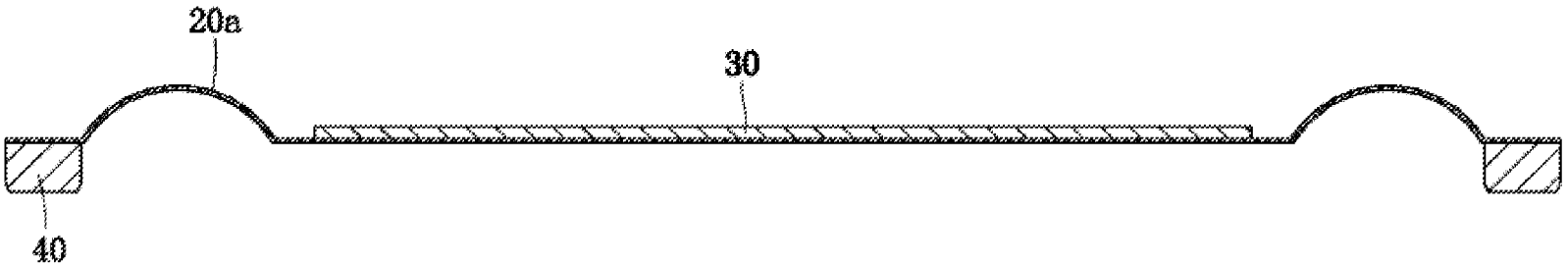
Fig. 1 (Prior Art)
FIG. 1 is a schematic view showing the cross-section structure of the diaphragm assembly in the prior art.

In the drawings: 20*a*-diaphragm; 20*b*-diaphragm; 20*c*-diaphragm; 20*d*-diaphragm; 20*e*-diaphragm; 20*f*-diaphragm; 20*g*-diaphragm; 20*h*-diaphragm; 30-dome; 40-support member.

DETAILED DESCRIPTION OF EMBODIMENTS

Hereinafter, the present application is described in detail in connection with the accompanying drawings and the embodiments.

In the present specification, the direction toward which the bending portion of the diaphragm protrudes is defined as the upward direction, and its opposite direction is defined as the downward direction. In the present specification, the inner lateral surface of the support member refers to the lateral surface of the support member closer to the center, and the outer lateral surface of the support member refers to the lateral surface of the support member away from the center.

Figure 2:
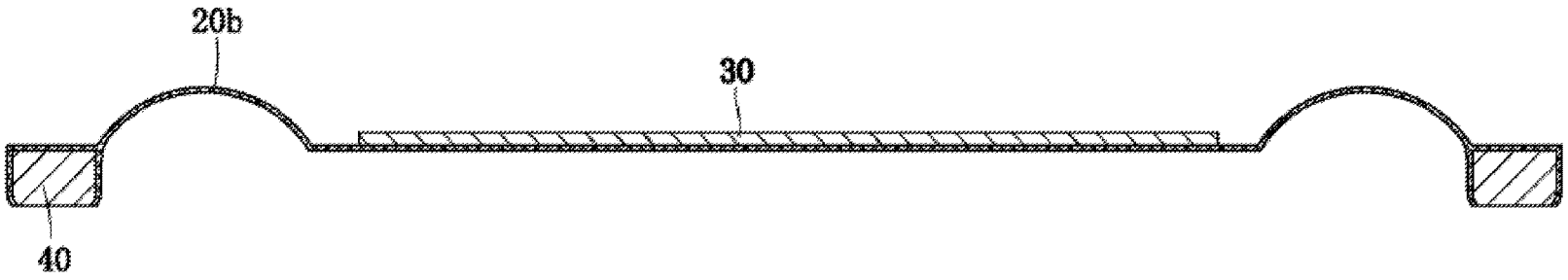
FIG. 2 is a schematic view showing the cross-section structure of the diaphragm assembly according to a first embodiment of the present application.

First Embodiment:

As shown in FIG. 2, a diaphragm assembly comprises a diaphragm 20*b*, and the diaphragm 20*b* is made of silica gel. The diaphragm 20*b* comprises an annular bending portion protruding upward, and a diaphragm center portion is provided at the inner side of the bending portion. The diaphragm center portion may be a closed structure or a ring-shaped structure with a center opening. In the present embodiment, it is preferable that the diaphragm center portion is a closed structure. A diaphragm edge portion having a planar structure is provided at the outer side of the bending portion, and the diaphragm center portion, the bending portion, and the diaphragm edge portion are formed as an integrated structure. The diaphragm edge portion is injection-molded with a support member 40 which is an annular structure corresponding to the shape of the diaphragm. The diaphragm edge portion is simultaneously coupled with the inner lateral surface, the outer lateral surface and the upper surface of the support member 40 through injection molding, that is, the diaphragm edge portion is an annular groove structure which opens downward, and the support member 40 is surrounded by the annular groove, except that the lower surface of the support member is exposed to the outside of the diaphragm edge portion.

As shown in FIG. 2, a dome 30 is bonded to the upper surface of the diaphragm center portion, and the dome 30 is a flat plate structure.

As shown in FIG. 2, the material of the support member 40 is stainless steel, brass or the like. When the support member 40 is a brass ring, as the diaphragm edge portion is wrapped around the lateral surfaces of the support member 40, the oxidation of the punching surface of the lateral surfaces of brass may be prevented, thereby decreasing the product requirements on the brass ring, simplifying the processing technology of the brass ring, and reducing raw material costs of the product.

As shown in FIG. 2, in the diaphragm assembly provided by the present application, during the molding of the silica gel diaphragm, the support member 40 is used as an insert and is disposed in the injection mold, and then the mold is filled with liquid silica gel material, and the diaphragm 20*b* is integral with the support member 40 while the diaphragm 20*b* is molded under higher temperature. Through such a bonding mode, i.e., injection molding, the bonding strength between the diaphragm 20*b* and the support member 40 is improved greatly, the diaphragm 20*b* will not be disengaged from the support member 40 during the operation of the loudspeaker, such that the stability and reliability of the product is greatly improved, the consistency of the product is good, its injection molding process is simple and easy to operate, thereby improving the production efficiency of the product effectively.

Figure 3:
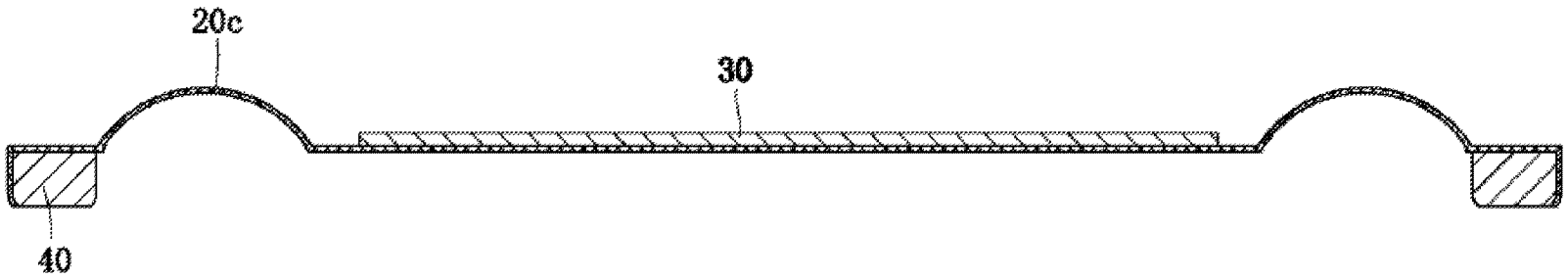
FIG. 3 is a schematic view showing the cross-section structure of the diaphragm assembly according to a second embodiment of the present application.

Second Embodiment:

As shown in FIG. 3, the present embodiment is basically the same as the first embodiment, except that:

the edge portion of the diaphragm 20*c* is only coupled with the outer lateral surface and the upper surface of the support member 40 through injection molding.

Compared with the first embodiment, the silica gel used in this embodiment is more economical and the structure in this embodiment is simpler, but the bonding strength between the diaphragm 20*c* and the support member 40 is slightly smaller.

Figure 4:
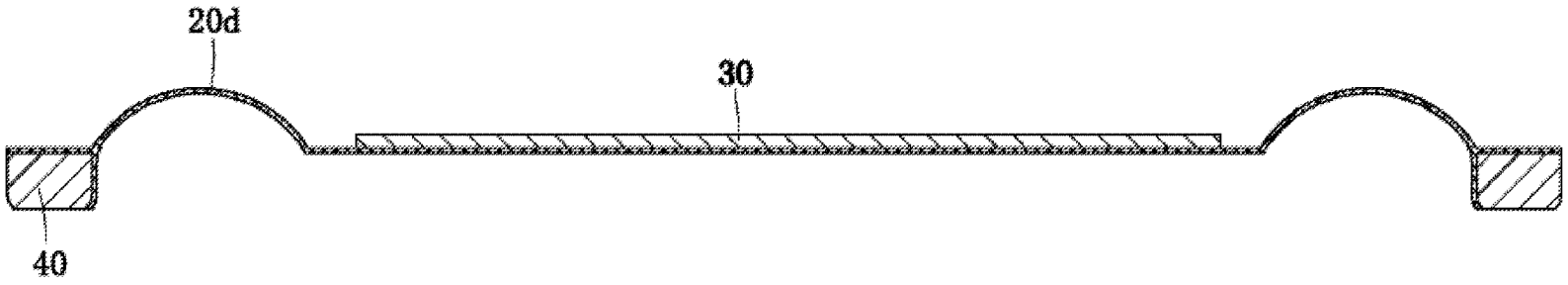
FIG. 4 is a schematic view showing the cross-section structure of the diaphragm assembly according to a third embodiment of the present application.

Third Embodiment:

As shown in FIG. 4, the present embodiment is basically the same as the first embodiment, except that:

the edge portion of the diaphragm 20*d* is only coupled with the inner lateral surface and the upper surface of the support member 40 through injection molding.

Compared with the first embodiment, the silica gel used in this embodiment is more economical and the structure in this embodiment is simpler, but the bonding strength between the diaphragm 20*d* and the support member 40 is slightly smaller.

Figure 5:
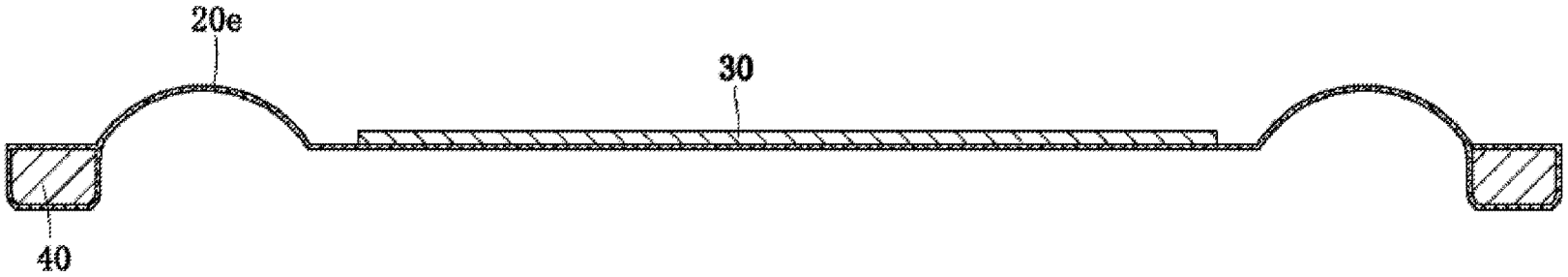
FIG. 5 is a schematic view showing the cross-section structure of the diaphragm assembly according to a fourth embodiment of the present application.

Fourth Embodiment:

As shown in FIG. 5, the present embodiment is basically the same as the first embodiment, except that:

the edge portion of the diaphragm 20*e* is simultaneously coupled with the inner lateral surface, the outer lateral surface, the upper surface and the lower surface of the support member 40 through injection molding, i.e., the entire support member 40 is surrounded by the diaphragm edge portion.

Compared with the first embodiment, the bonding strength between the diaphragm 20*e* and the support member 40 in this embodiment is higher, and the diaphragm 20*e* will not be disengaged from the support member 40 whether the diaphragm 20*e* vibrates upward or downward, only that slightly more silica gel is used and the diaphragm assembly is slightly heavier.

Fifth Embodiment:

The present embodiment is basically the same as the first to fourth embodiments, except that:

the diaphragm center portion is coupled with the dome 30 through injection molding, as illustrated below in connection with FIGS. 6, 7 and 8.

Figure 6:
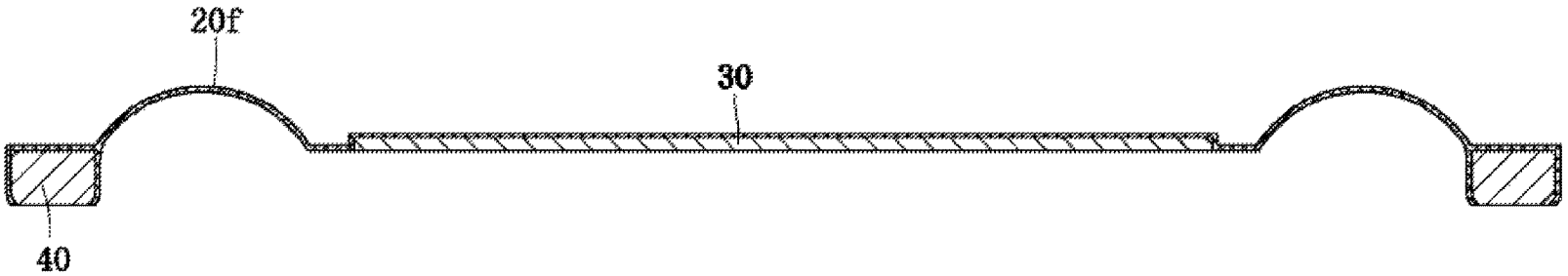
FIG. 6 is a schematic view showing a cross-section structure of the diaphragm assembly according to a fifth embodiment of the present application.

As shown in FIG. 6, the center portion of the diaphragm 20*f* is a closed structure which is coupled with the lateral surfaces and the upper surface of the dome 30 through injection molding.

Figure 7:
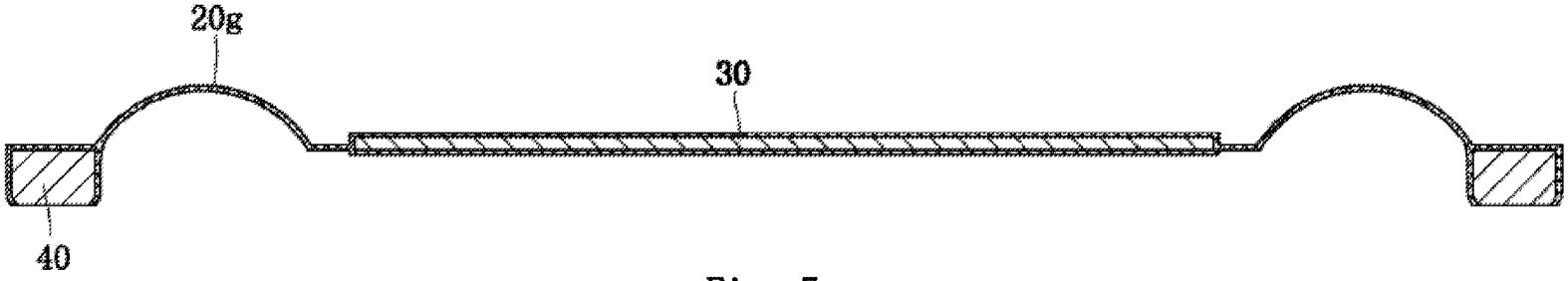
FIG. 7 is a schematic view showing another cross-section structure of the diaphragm assembly according to the fifth embodiment of the present application.

As shown in FIG. 7, the center portion of the diaphragm 20*g* is also a closed structure which is coupled with the lateral surfaces, the upper surface and the lower surface of the dome 30 through injection molding, i.e., the dome 30 is surrounded by the diaphragm center portion.

Figure 8:
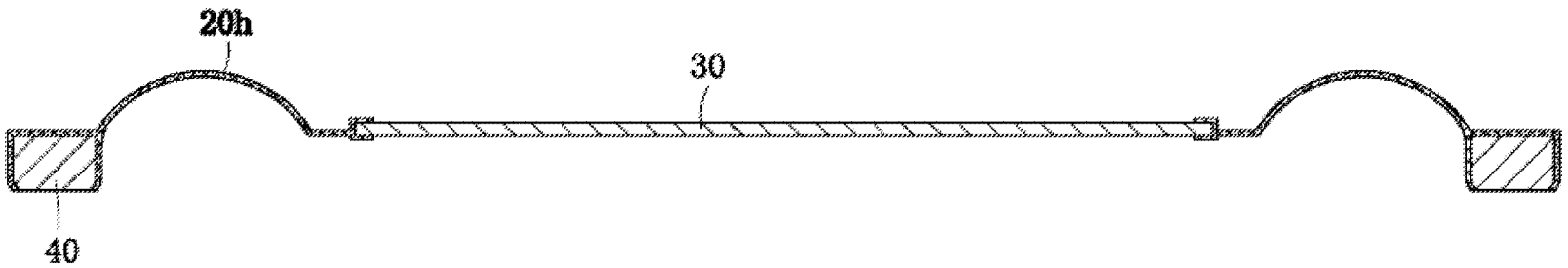
FIG. 8 is a schematic view showing yet another cross-section structure of the diaphragm assembly according to the fifth embodiment of the present application.

As shown in FIG. 8, the center portion of the diaphragm 20*h* is an annular structure with a center opening, and the center portion of the diaphragm 20*h* is only coupled with the lateral surfaces as well as the edge portions of the upper surface and the lower surface of the dome 30 through injection molding, i.e., the diaphragm center portion is an annular groove structure which opens inward, and the dome 30 is clamped in the annular groove.

Compared with the first to the fourth embodiments, the stability and reliability of the product in this embodiment are higher, the consistency of the product in this embodiment is better, and the production efficiency of the product in this embodiment is higher.

The combination mode of the diaphragm center portion and the dome 30 is not limited to the above-described three structures which are merely illustrative examples of injection molding for the diaphragm center portion and the dome 30, and the diaphragm center portion may be only coupled with the lateral surfaces and the edge of the upper/lower surface of the dome 30 through injection molding, etc. Other combination modes of the diaphragm center portion and the dome 30 may be achieved by those skilled in the art without any creative labor according to the description of the present specification, and thus their particular embodiments are not detailed herein.

Sixth Embodiment:

A loudspeaker comprises a vibration system and a magnetic circuit system, and the vibration system comprises a diaphragm assembly and a voice coil which are joined together. The diaphragm assembly is a diaphragm assembly described in the first to the fifth embodiments.

As the diaphragm assembly described in the first to the fifth embodiments is utilized in the loudspeaker of the present application, the diaphragm will not be disengaged from the support member or the dome when the loudspeaker operates, such that the reliability and stability are higher and the service life is longer.

In the present specification, the technical solution for joining the silica gel diaphragm and the support member through injection molding in the present application is illustrated by taking the diaphragm assemblies and the loudspeakers with the above structures as examples. This technical solution can be applied to the diaphragm assemblies and the loudspeakers with the above structures, but also can be applied to any diaphragm assembly and loudspeaker with a diaphragm made of silica gel in practical application. The technical solution of the present application can be applied to the diaphragm assemblies and loudspeakers with other structures by those skilled in the art without any creative labor according the description of the present specification. Thus, whether the structures of the diaphragm assembly and the loudspeaker are the same as that of the diaphragm assembly and the loudspeaker in the above-described embodiments or not, the technical solution that the silica gel diaphragm is coupled with the support member through injection molding so as to improve the bonding strength of the diaphragm assembly and the loudspeaker, falls into the protection scope of the present application.

The present application is not limited to the above specific embodiments, and various variations made by those skilled in the art according to the above conceptions without creative labor fall into the protection scope of the present application.

The invention claimed is:

1. A diaphragm assembly, comprising a silica gel diaphragm, wherein the diaphragm comprises an annular bending portion, and a diaphragm center portion and a diaphragm edge portion arranged at an inner side and an outer side of the bending portion, respectively, wherein the diaphragm edge portion is coupled with an annular support member through injection molding, and the diaphragm center portion is coupled with a dome, wherein the support member is disposed in an injection mold as an insert when injection molding the diaphragm so that the diaphragm is formed to be integrated with the support member, wherein the diaphragm edge portion is simultaneously coupled with an inner lateral surface, an outer lateral surface, an upper surface and a lower surface of the support member through the injection molding.

2. The diaphragm assembly according to claim 1, wherein the diaphragm center portion is coupled with the dome through adhesive bonding.

3. The diaphragm assembly according to claim 1, wherein the diaphragm center portion is coupled with the dome through injection molding.

4. A loudspeaker, comprising a vibration system and a magnetic circuit system, wherein the vibration system comprises the diaphragm assembly according to claim 1.

5. The diaphragm assembly according to claim 1, wherein the center portion of the diaphragm is a closed structure.

6. The diaphragm assembly according to claim 5, wherein the diaphragm is coupled with the lateral surfaces and the upper surface of the dome.

7. The diaphragm assembly according to claim 5, wherein the diaphragm is coupled with the lateral surfaces, the upper surface and the lower surface of the dome.

8. The diaphragm assembly according to claim 1, wherein the center portion of the diaphragm is an annular structure with a center opening, and the center portion of the diaphragm is coupled with the lateral surfaces as well as the edge portions of the upper surface and the lower surface of the dome.

9. The diaphragm assembly according to claim 1, wherein the support member is a metallic member.

10. The diaphragm assembly according to claim 9, wherein a material of the support member is stainless steel or brass.

* * * * *